US005400893A

United States Patent [19]

Spatafora

[11] Patent Number: 5,400,893

[45] Date of Patent: Mar. 28, 1995

[54] BULK FED PRODUCT ORDERING DEVICE, PARTICULARLY FOR CONFECTIONERY

[75] Inventor: Mario Spatafora, Bologna, Italy

[73] Assignee: Azionaria Costruzioni Macchine Automatiche A.C.M.A. S.P.A., Bologna, Italy

[21] Appl. No.: 143,062

[22] Filed: Oct. 29, 1993

[30] Foreign Application Priority Data

Oct. 30, 1992 [IT] Italy ..... BO92A0384

[51] Int. Cl.[6] ..... B65G 47/14

[52] U.S. Cl. ..... 198/396; 198/392

[58] Field of Search ..... 198/383, 390, 392, 396, 198/750, 757

[56] References Cited

U.S. PATENT DOCUMENTS

| | | | |
|---|---|---|---|
| 3,414,112 | 12/1968 | Ravn | 198/757 X |
| 3,757,932 | 9/1973 | Baljet et al. | 198/757 |
| 4,245,733 | 1/1981 | Kubota et al. | 198/396 X |
| 4,462,508 | 7/1984 | Grafius | 198/396 X |
| 4,699,261 | 10/1987 | Nesin | 198/396 X |
| 4,921,106 | 5/1990 | Spatafora et al. | 198/392 X |
| 5,044,487 | 9/1991 | Spatafora et al. | 198/392 |

FOREIGN PATENT DOCUMENTS

| | | | |
|---|---|---|---|
| 02-31307 | 9/1990 | Japan | 198/392 |
| 1297083 | 11/1972 | United Kingdom | 198/392 |
| 2090236 | 7/1982 | United Kingdom | 198/396 |

*Primary Examiner*—James R. Bidwell

*Attorney, Agent, or Firm*—Oblon, Spivak, McClelland, Maier, & Neustadt

[57] ABSTRACT

A device for ordering bulk fed confectionery products, wherein a continuously rotating annular accelerating and transfer element is interposed between the outer periphery of a discontinuously rotating central plate, designed to receive the products in bulk, and an annular conveyor having a number of pockets, each for receiving a respective product.

7 Claims, 4 Drawing Sheets

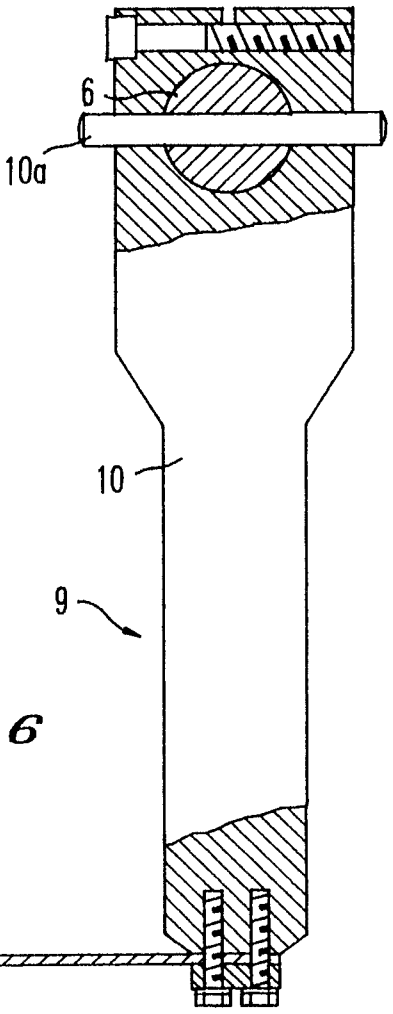
FIG. 6
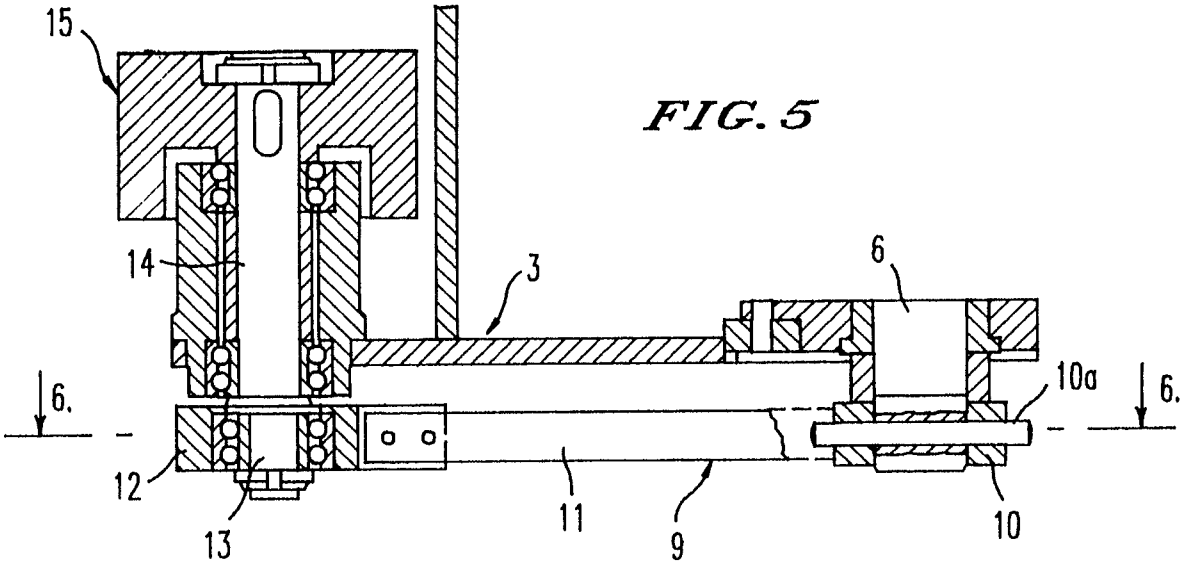
FIG. 5
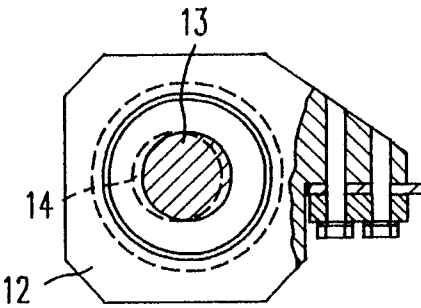

BULK FED PRODUCT ORDERING DEVICE, PARTICULARLY FOR CONFECTIONERY

BACKGROUND OF THE INVENTION

The present invention relates to a device for ordering bulk fed products, particularly confectionery.

The present invention is particularly suitable for use on wrapping lines for confectionery products in general, and sweets in particular, to which the following description refers purely by way of example.

On leaving the production machine, sweets are normally fed in bulk to a wrapping machine, immediately upstream from which they are arranged in an orderly sequence by means of an ordering device.

Known ordering devices normally comprise a ring with a succession of equally spaced peripheral pockets, each designed to receive a respective sweet; and a centrifugal disc inside and coaxial with the ring, for receiving a number of randomly arranged sweets off the production machine and spinning them into respective pockets on the ring.

On known ordering devices of the aforementioned type, the sweets, by virtue of being fed over the disc and into the pockets substantially continuously and exclusively by centrifugal force, engage the pockets at relatively high speed frequently sufficient to result in at least partial damage.

SUMMARY OF THE INVENTION

It is an object of the present invention to provide a straightforward, low-cost ordering device designed to overcome the aforementioned drawback.

According to the present invention, there is provided a device for ordering bulk fed products, particularly confectionery, the device comprising conveyor means with a succession of equally spaced pockets, each designed to receive a respective product; and centrifugal handling means for feeding the products into said pockets; the centrifugal means being substantially tangent to the conveyor means, and comprising a central plate mounted for rotation about its axis and designed to receive said products in bulk; and the device being characterized by the fact that said centrifugal means also comprise an annular product conveying element about the outer periphery of said plate; first activating means for rotating said plate discontinuously, and preferably in reciprocating manner, about said axis; and second activating means for rotating said annular element continuously about said axis at a first given speed.

According to a preferred embodiment of the above ordering device, said discontinuous rotary movement is a reciprocating helical movement.

The products fed in bulk on to the central plate are thus substantially jogged towards the periphery of the plate, and reach the annular element at a speed having a relatively reduced centrifugal component. The annular element, rotating at continuous speed, provides for simply accelerating the products in a direction substantially tangent to the plate, so that they are fed on to the conveyor means with a relatively reduced centrifugal component and such as to enable them to safely engage the respective pockets with no damage whatsoever.

BRIEF DESCRIPTION OF THE DRAWINGS

A non-limiting embodiment of the present invention will be described by way of example with reference to the accompanying drawings, in which:

FIG. 5 shows a section of a second detail in FIG. 2;

FIG. 6 shows a section along line VI—VI in FIG. 5.

DETAILED DESCRIPTION OF THE INVENTION

Figure 1:
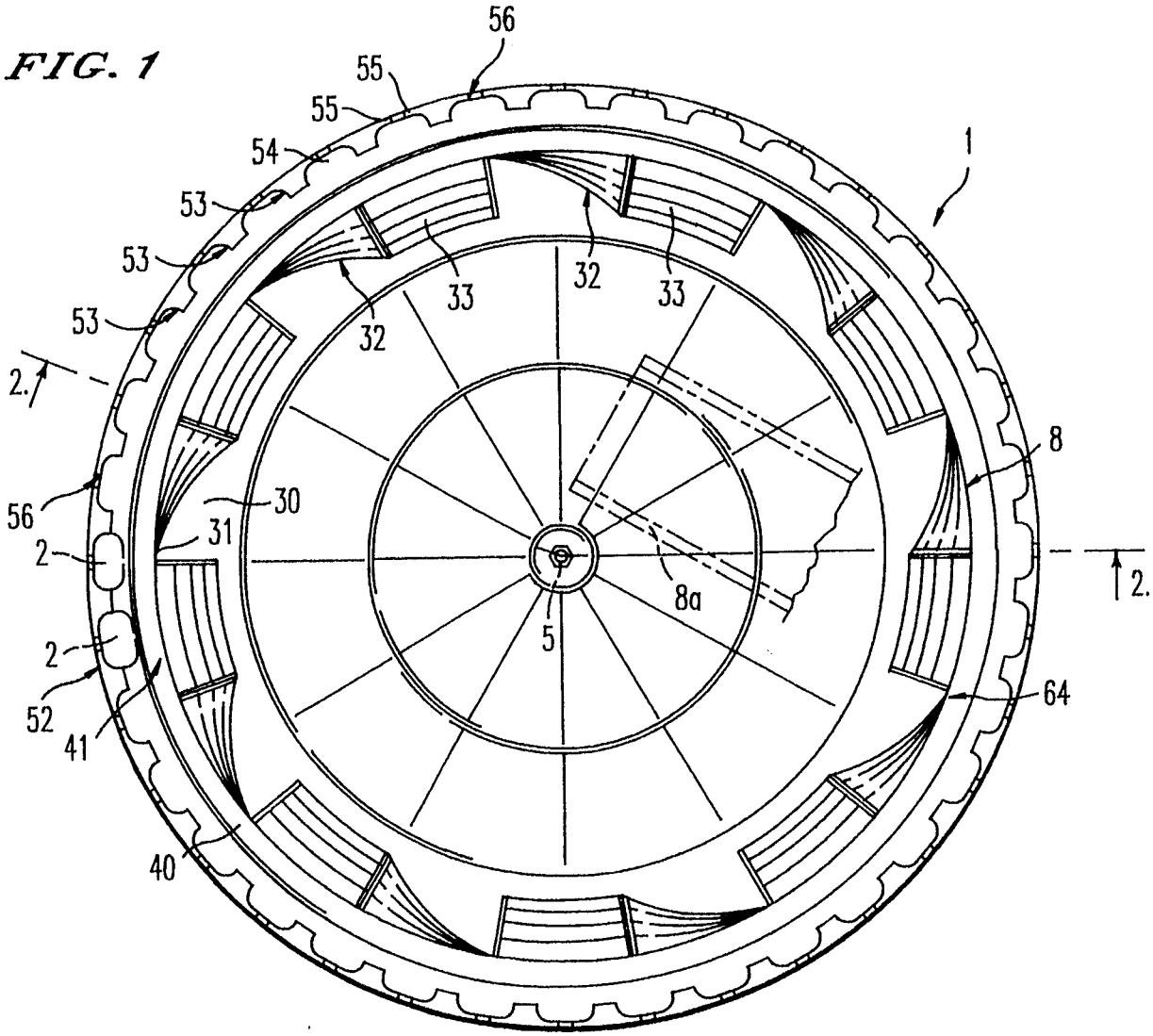
FIG. 1 shows a plan view of a preferred embodiment of the ordering device according to the present invention.
Figure 2:
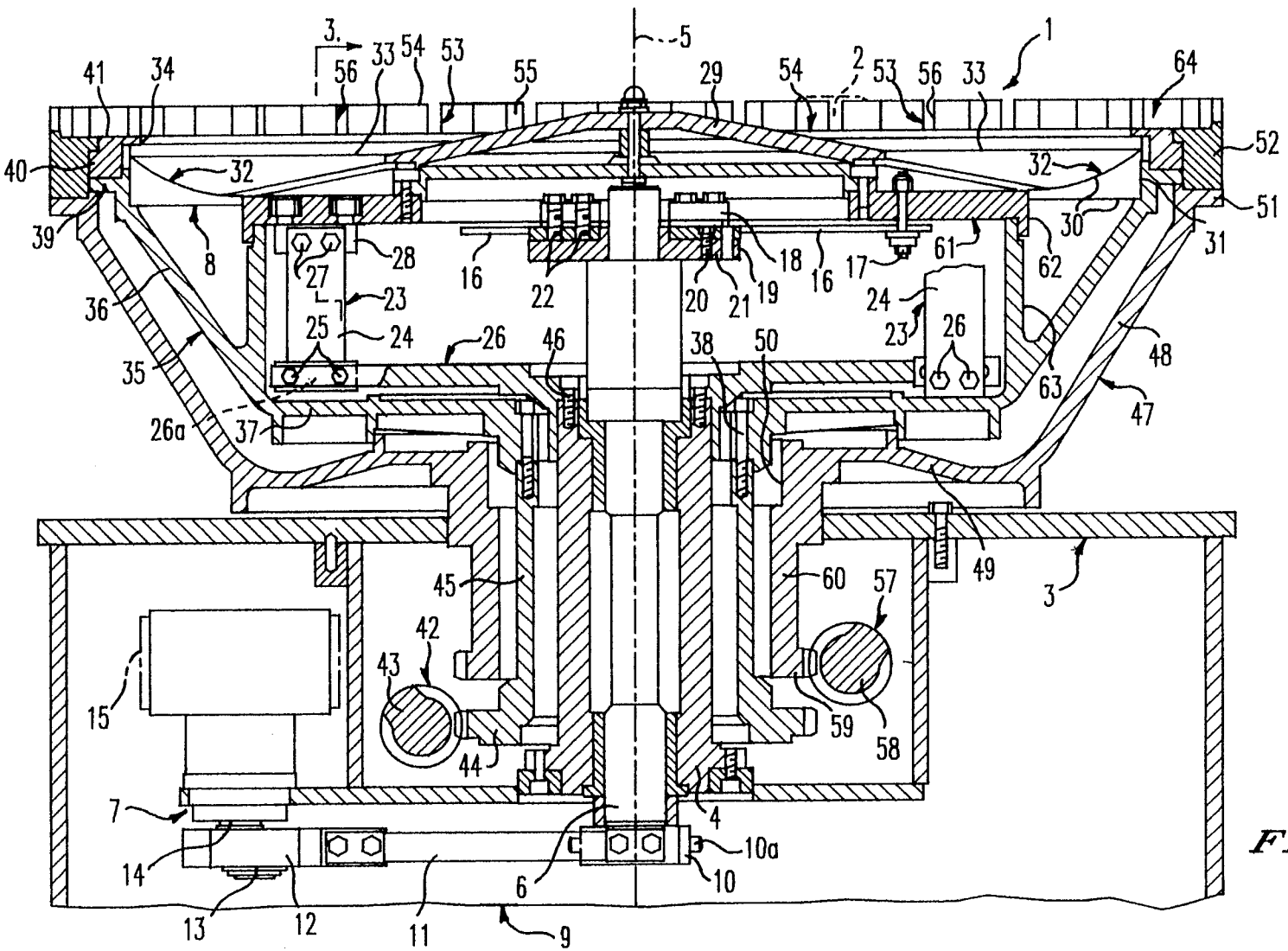
FIG. 2 shows a larger-scale section along line II—II in FIG. 1.

Number 1 in FIGS. 1 and 2 indicates a device for ordering bulk fed confectionery products, particularly sweets 2, for supply to a wrapping machine (not shown).

As shown in FIG. 2, device 1 comprises a fixed supporting frame 3 in turn comprising a central cylindrical tubular body 4 having a substantially vertical axis 5 and engaged in rotary and axially fixed manner by a drive shaft 6 coaxial with and projecting outwards from the opposite ends of tubular body 4. Shaft 6 presents a bottom end portion connected to an actuating device 7 for rotating shaft 6 in reciprocating manner about axis 5 and in relation to frame 3; and a top end portion fitted angularly integral with a plate 8 for receiving sweets 2 in bulk from an overhead conduit 8*a* (FIG. 1) constituting the output of a sweet manufacturing machine (not shown).

More specifically, actuating device 7 comprises a connecting rod-crank drive device 9 in turn comprising a crank 10 having one end portion fitted to the bottom end portion of shaft 6 by means of a pin 10*a*, and the opposite end portion connected integral with one end of a connecting rod 11 defined by a flexible blade substantially perpendicular to axis 5 (FIGS. 5 and 6). The end of connecting rod 11 opposite that connected to crank 10 extends substantially radially outwards from a hub 12 mounted for rotation on the eccentric end portion 13 of a drive shaft 14 substantially parallel to shaft 6 and connected, by the end portion opposite portion 13, to the output of a powered belt drive 15.

Figure 4:
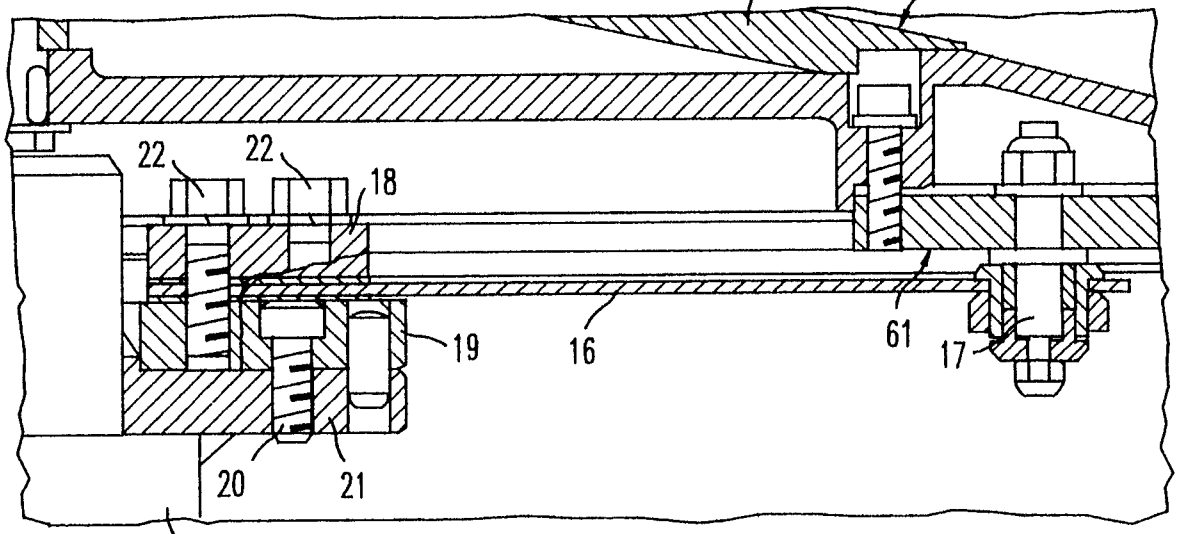
FIG. 4 shows a larger-scale view of a first detail in FIG. 2.

Plate 8 is connected, coaxial with axis 5, to the top portion of shaft 6 by means of a number of flat spring blades 16 (only two shown in FIG. 2) extending substantially radially outwards from shaft 6 and in a plane substantially perpendicular to axis 5. As shown more clearly in FIG. 4, each blade 16 presents an end portion connected integral with plate 8 by means of a respective screw 17; and an opposite end portion gripped between two rings 18 and 19. Ring 19 is connected by means of a number of screws 20 (only one shown in FIG. 2) to an outer flange 21 of shaft 6, and ring 18 to ring 19 by means of a number of screws 22.

Figure 3:
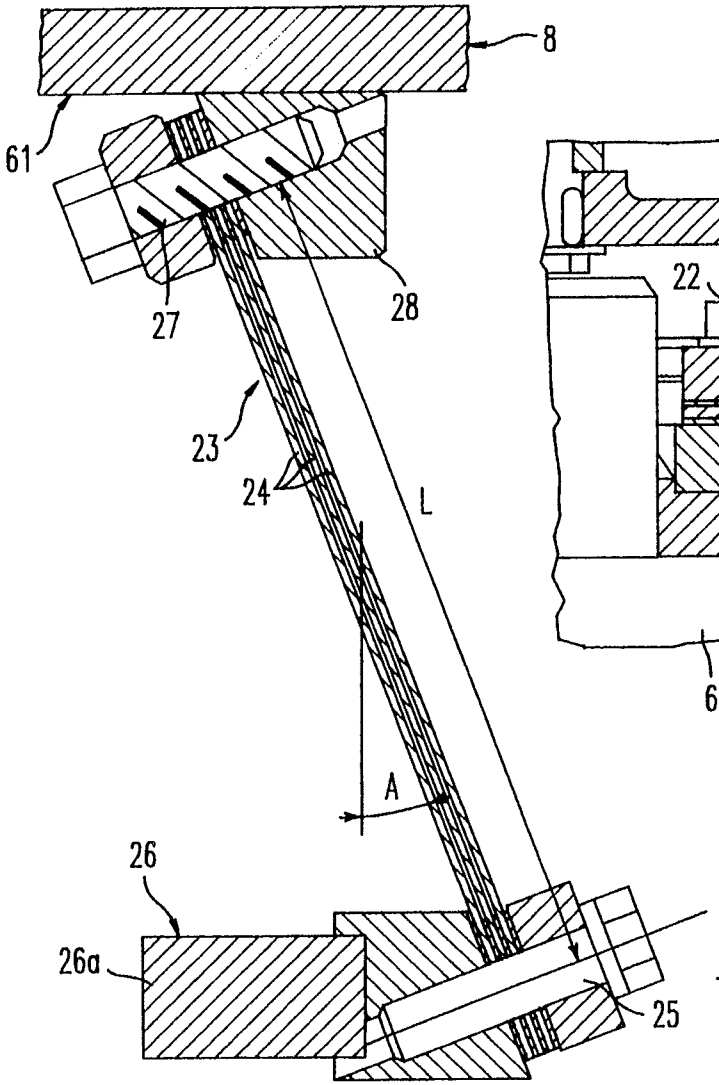
FIG. 3 shows a larger-scale section along line III—III in FIG. 2.

Plate 8 is also secured to frame 3 by cam means consisting of a number of flexible plates 23 formed, as shown in FIG. 3, by a number of superimposed, mutually spaced elastic blades 24. Each plate 23 is positioned substantially vertically, and, by means of screws 25 connecting blades 24, is connected flat at the bottom end to the lateral surface of a respective appendix 26*a* extending outwards from the outer periphery of a flange 26 on tubular body 4. The top end of each plate 23 is connected flat, by means of screws 27, to the lateral surface of a respective bottom radial rib 28 on plate 8.

When idle, as opposed to lying in the same radial plane through axis 5, rib 28 and appendix 26*a* of each plate 23 lie in two different radial planes offset angularly so as to support plate 23 inclined by a given angle A (FIG. 3) in relation to the radial plane through, say, respective appendix 26*a*. By moving shaft 6 angularly by a given amount about axis 5, it is possible to elastically deform plates 23 so as to substantially zero angle A and, by elastically deforming blades 16 vertically, increase the distance between plate 8 and flange 26 by an amount equal to "L(1-cos A)", where L is the distance between the axes of screws 25 and 27.

By rotating shaft 6 reciprocatingly by means of actuating device 7, a reciprocating rotary movement in general, and a reciprocating helical movement in particular, may thus be imparted to plate 8.

Again with reference to FIG. 2, plate 8 is defined at the top by a central convex conical element 29 coaxial with axis 5, and by a flat annular plate 30 perpendicular to axis 5, the inner periphery of which is integral with the larger end of element 29, and from the outer periphery of which a cylindrical wall 31 extends upwards coaxial with axis 5. Plate 30 presents a number of equally spaced helical ramps 32 extending along the inner surface of cylindrical wall 31 and terminating at the top end with a flat circular platform 33 extending along a respective portion of wall 31 and slightly below the level of the top free edge 34 of wall 31.

Again with reference to FIG. 2, device 1 also comprises a first cup-shaped body 35 coaxial with axis 5 and in turn comprising a lateral wall 36 extending outside plate 8 and plates 23, and a bottom wall 37 extending beneath flange 26 and having a hole 38 coaxial with axis 5 and engaged loosely by tubular body 4. Body 35 terminates at the top with an outer flange 39 integral with wall 36, adjacent to the top edge of wall 36, located below edge 34 of plate 8, and fitted integral with an annular element 40 coaxial with axis 5 and defined at the top by a flat annular conveying surface 41 above edge 34.

Body 35 and element 40 are rotated at a constant speed V1 in relation to frame 3 and about axis 5 by a worm and helical gear device 42 comprising a worm 43 substantially perpendicular to axis 5, and a gear 44 on the bottom end portion of a sleeve 45. Sleeve 45 is connected in rotary and axially fixed manner to tubular body 4, and, at the end opposite that fitted with gear 44, is connected integral with wall 37 of body 35 by means of a number of screws 46.

Again with reference to FIG. 2, device 1 also comprises a second cup-shaped body 47 extending coaxially with axis 5 and outside body 35, and in turn comprising a lateral wall 48 substantially parallel to wall 36, and a bottom wall 49 with a hole 50 coaxial with axis 5 and engaged loosely by sleeve 45. The top end of body 47 presents an outer flange 51 parallel to and lower than flange 39, and fitted integral with a conveyor ring 52 coaxial with and substantially tangent to the periphery of element 40.

Ring 52 presents a number of peripheral pockets 53, each having its concavity facing axis 5, and each designed to house a respective sweet 2. More specifically, when viewed from above, each pocket 53 is substantially rectangular with its longer axis substantially tangent to the outer periphery of ring 52, and is defined at the bottom by a flat surface 54 coplanar with surface 41 of element 40, and laterally by a wall 55 through which is formed an axial slot 56 enabling insertion of the arms of a pickup grip (not shown).

Body 47 and ring 52 are rotated about axis 5 and in relation to frame 3 at a speed V2 greater than speed V1 by a worm and helical gear device 57 comprising a worm 58 substantially perpendicular to axis 5, and a gear 59 on the end portion of a sleeve 60 extending outwards of sleeve 45, connected in rotary and axially fixed manner to sleeve 45, and integral with wall 49.

In actual use, and commencing from the condition in which element 40 and ring 52 are rotated at respective speeds V1 and V2 by respective devices 42 and 57, and in which a number of sweets 2 (not shown) are loaded on to plate 8, activation of device 7, as already stated, provides for imparting to plate 8 a discontinuous rotary movement about axis 5, in particular a reciprocating helical movement about and along axis 5, by elastically and cyclically deforming blades 16 and 24 as of a lowered idle position (FIG. 2) wherein the bottom edge of lateral wall 62 of a bottom cup-shaped body 61 of plate 8 rests on a limit stop defined by the top edge of a cylindrical wall 63 coaxial with axis 5 and extending upwards from the outer periphery of bottom wall 37 of body 35. As a result of said reciprocating helical movement of plate 8, sweets 2 are fed successively by centrifugal force and inertia along ramps 32 on to respective platforms 33, and over edge 34 of wall 31 on to annular conveying surface 41 of element 40, which provides for accelerating sweets 2 to a traveling speed substantially equal to speed V1. By virtue of the relatively small radial dimension of element 40, this exerts relatively little centrifugal force on sweets 2, but sufficient for transferring them from surface 41 on to surface 54 of ring 52, which further accelerates sweets 2 to speed V2 of pockets 53, and so increases the centrifugal force on sweets 2 as to feed and subsequently retain them inside respective pockets 53 from which they are removed successively by grips (not shown).

In other words, therefore, plate 8 and element 40 combine to form a centrifugal element 64, along a first portion of which, defined by plate 8, sweets 2 are substantially jogged in a substantially radial direction and at relatively low radial speed, and along a second portion of which sweets 2 are again advanced at very low radial speed and at a tangential speed substantially equal to speed V1. Ring 52, on the other hand, defines an annular pocket type conveyor for tangentially accelerating sweets 2 to speed V2, and feeding them radially outwards at relatively slow speed and safely into respective pockets 53.

I claim:

1. A device for ordering bulk fed products, particularly confectionery, the device comprising conveyor means extending on a predetermined plane with a succession of equally spaced pockets, each of said pockets designed to receive a respective product; and centrifugal handling means for feeding the products into said pockets; the centrifugal means being substantially tangent to the conveyor means, and comprising a central plate mounted at a level below said predetermined plane for rotation about an axis and designed to receive said products in bulk, and an annular product conveying element extending on said predetermined plane about an outer periphery of said central plate; first activating means for imparting a reciprocating helical movement to said central plate about said axis; and second activating means for rotating said annular product conveying element continuously about said axis at a first given speed; the conveyor means having an inner periphery substantially in contact with an external periphery of said annular product conveying element.

2. A device as claimed in claim 1, wherein said conveyor means comprise a ring mounted for rotation about said axis and surrounding said centrifugal means; said ring presenting said pockets; and second activating means being provided for rotating the ring about said axis at a second given constant speed.

3. A device as claimed in claim 2, wherein said second given speed is greater than said first given speed.

4. A device as claimed in claim 1, wherein said first activating means comprise a shaft coaxial with said axis; an actuating device for rotating said shaft reciprocatingly about said axis; means for connecting said plate in angularly fixed and axially movable manner to said shaft; and cam means connected to said plate, for moving the plate along said axis subsequent to rotation of said shaft about said axis.

5. A device as claimed in claim 4, wherein said cam means comprise a number of elastic, substantially vertical plates, each inclined close to a substantially radial plane in relation to said plate, and having a fixed bottom end and a top end connected integral with said plate; said two ends normally being offset circumferentially about said axis, and being movable in relation to each other, by elastically deforming the respective plate, for varying the inclination of the plate in relation to said radial plane.

6. A device as claimed in claim 4, wherein said connecting means comprise a number of elastic blades extending radially from said shaft and having a first end integral with said shaft and a second end integral with said plate.

7. The device of claim 1, wherein said central plate includes a plate surface having a plurality of ramps extending therefrom, with said ramps each extending from said plate surface to a respective substantially flat platform disposed above said plate surface, with said ramps and flat platforms disposed at an outer periphery of said central plate.

* * * * *